US009368075B2

(12) United States Patent
Lee et al.

(10) Patent No.: US 9,368,075 B2
(45) Date of Patent: Jun. 14, 2016

(54) METHOD OF DRIVING DUAL MODE LIQUID CRYSTAL DISPLAY DEVICE

(71) Applicant: LG Display Co., Ltd., Seoul (KR)

(72) Inventors: Joong-Ha Lee, Gyeonggi-do (KR); Dong-Guk Kim, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 381 days.

(21) Appl. No.: 13/921,317

(22) Filed: Jun. 19, 2013

(65) Prior Publication Data

US 2014/0009454 A1 Jan. 9, 2014

(30) Foreign Application Priority Data

Jul. 4, 2012 (KR) ..... 10-2012-0072934

(51) Int. Cl.
*G09G 3/36* (2006.01)
*G09G 3/20* (2006.01)

(52) U.S. Cl.
CPC ..... *G09G 3/36* (2013.01); *G09G 3/3648* (2013.01); *G09G 3/2011* (2013.01); *G09G 3/3614* (2013.01); *G09G 2300/0426* (2013.01); *G09G 2300/0434* (2013.01); *G09G 2300/0482* (2013.01); *G09G 2310/0245* (2013.01); *G09G 2330/021* (2013.01)

(58) Field of Classification Search
CPC . G02F 1/13718; G02F 1/1334; G02F 1/1391; G02F 2001/134381; G02F 1/1337
See application file for complete search history.

(56) References Cited

U.S. PATENT DOCUMENTS

2005/0001972 A1* 1/2005 Roosendaal ..... G02F 1/1391 349/179
2011/0267552 A1* 11/2011 Kim ..... G09G 3/2025 349/33

* cited by examiner

*Primary Examiner* — Kathy Wang-Hurst
*Assistant Examiner* — Peijie Shen
(74) *Attorney, Agent, or Firm* — Morgan, Lewis & Bockius LLP

(57) ABSTRACT

A method of driving a dual mode liquid crystal display device includes: applying a first horizontal electric field to the liquid crystal layer for a first duration time during a reset period of a memory mode, the first duration time longer than a frame; eliminating the first horizontal electric field and keeping the liquid crystal layer without the first horizontal electric field for a second duration time during the reset period of the memory mode; applying a first vertical electric field corresponding to a static image for a third duration time during a writing period of the memory mode, the third duration time longer than the frame; and eliminating the first vertical electric field and keeping the liquid crystal layer without the first vertical electric field for a fourth duration time during the writing period of the memory mode.

13 Claims, 4 Drawing Sheets

METHOD OF DRIVING DUAL MODE LIQUID CRYSTAL DISPLAY DEVICE

CROSS REFERENCE TO RELATED APPLICATIONS

The present application claims the benefit of priority of Korean Patent Application No. 10-2012-0072934 filed in the Republic of Korea on Jul. 4, 2012, which is hereby incorporated by reference in its entirety.

FIELD OF THE DISCLOSURE

The present disclosure relates to a liquid crystal display device. The present disclosure also relates to a method of driving a dual mode liquid crystal display device which operates in a memory mode or a dynamic mode.

DISCUSSION OF THE RELATED ART

Recently, as the information age progresses, demand for display devices has increased in various forms. For example, various flat panel displays (FPDs) such as a liquid crystal display (LCD) device, a plasma display panel (PDP), a field emission display (FED) device and an organic light emitting diode (OLED) display devices have been researched. Among various FPDs, the LCD device has various features such as a small size, a light weight, a thin profile and a low power consumption.

An electro optic effect of a liquid crystal of the LCD device means a phenomenon such that an electric light modulation is generated from a change in optical property of a liquid crystal cell. The electro optic effect is caused by a change of the liquid crystal from one alignment state to another alignment state due to application of an electric field.

In general, a liquid crystal for the LCD device may be classified into a nematic type, a smectic type and a cholesteric type. The nematic type liquid crystal that scatters light most strongly when alignment is disordered is widely used for the LCD device. The LCD device including the nematic type liquid crystal uses a property such that a molecular alignment of the nematic type liquid crystal is sequentially changed when an electric field is applied. For example, a twisted nematic (TN) type liquid crystal and a super twisted nematic (STN) liquid crystal may be used as the nematic type liquid crystal.

In a TN mode LCD device, first and second alignment layers are formed on a pixel electrode of a first substrate and a common electrode of a second substrate, respectively, and a nematic type liquid crystal is formed between the first and second alignment layers. Since a long axis of the nematic type liquid crystal adjacent to the first alignment layer and a long axis of the nematic type liquid crystal adjacent to the second alignment layer have about 90 degree with respect to each other due to the first and second alignment layers, the nematic type liquid crystal has a twisted alignment state where the long axes of the nematic type liquid crystal are sequentially twisted from the pixel electrode to the common electrode.

When a data voltage and a common voltage are applied to the pixel electrode and the common electrode, respectively, to generate a vertical electric field between the pixel electrode and the common electrode and the nematic type liquid crystal in a liquid crystal layer between the pixel electrode and the common electrode are re-aligned according to the vertical electric field. As a result, a transmittance of the liquid crystal layer is changed and images are displayed.

The TN mode LCD device displays images by re-aligning the nematic type liquid crystal according to the vertical electric field generated by a voltage difference between the pixel electrode and the common electrode. When the vertical electric field is not generated, the nematic type liquid crystal return to an initial alignment state. Accordingly, the data voltage and the common voltage are kept to be applied to the pixel electrode and the common electrode for the TN mode LCD device to display images.

Recently, various display devices have been suggested to satisfy rapidly diversified consumer's demand. Specifically, various products for a light weight, a thin profile and a high energy efficiency have been introduced due to improvement in environment for information usage and portability of device.

Among various display devices, an LCD device including a bi-stable chiral splay nematic (BCSN) type liquid crystal has been suggested for an E-book or an E-paper. In the E-book or the E-paper, a static image such as a text is displayed for a relatively long time period without changes. When the TN mode LCD device is applied to the E-book or the E-paper, a relatively high power is unnecessarily consumed for displaying a static image for a relatively long time period as for displaying a moving image. As a result, a BCSN mode LCD device, which is capable of displaying both of white and black without supply of a voltage using the BCSN type liquid crystal an alignment state of which is kept in a splay state and a $\pi$-twist state without supply of a voltage, has been suggested.

Although the BCSN mode LCD device displays a static image such as a text with a relatively low power consumption, the BCSN mode LCD device may have a disadvantage in displaying a moving image because the BCSN mode LCD device can hardly display grey levels. As a result, although the BCSN mode LCD device operates in a memory mode where a static image is displayed with a relatively low power consumption, the BCSN mode LCD device may not operate in a dynamic mode where a moving image is displayed.

SUMMARY OF THE INVENTION

Accordingly, embodiments of the present invention are directed to a method of driving a dual mode liquid crystal display device that substantially obviates one or more of the problems due to limitations and disadvantages of the related art.

An object of the present disclosure is to provide a method of driving a dual mode liquid crystal display device in a memory mode and a dynamic mode.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages, as embodied and broadly described herein, there is provided a method of driving a dual mode liquid crystal display device comprising first and second substrates facing and spaced apart from each other, the first and second substrates including a plurality of pixel regions, a first electrode in each of the plurality of pixel regions on an inner surface of the first substrate, a second electrode on an inner surface of the second substrate, third and fourth electrodes on one of the inner surfaces of the first and second substrates, the third and fourth electrodes spaced apart from each other, and a liquid crystal layer between the first and second substrates, the liquid crystal layer including a liquid crystal and a chiral dopant, including: a first step of applying a first horizontal electric field to the liquid crystal layer for a first duration time during a reset period of a memory mode, the first duration time longer than a frame; a second step of eliminating the first horizontal electric field and keeping the liquid crystal layer without the first horizontal electric field for a second duration time during the reset period of the memory mode; a third step of applying a first vertical electric field corresponding to a static image for a third duration time during a writing period of the memory mode, the third duration time longer than the frame; and a fourth step of eliminating the first vertical electric field and keeping the liquid crystal layer without the first vertical electric field for a fourth duration time during the writing period of the memory mode.

In another aspect, there is provided a method of driving a dual mode liquid crystal display device comprising first and second substrates facing and spaced apart from each other, the first and second substrates including a plurality of pixel regions, a first electrode in each of the plurality of pixel regions on an inner surface of the first substrate, a second electrode on an inner surface of the second substrate, third and fourth electrodes on one of the inner surfaces of the first and second substrates, the third and fourth electrodes spaced apart from each other, and a liquid crystal layer between the first and second substrates, the liquid crystal layer including a liquid crystal and a chiral dopant, including: a first step of applying a first vertical electric field to the liquid crystal layer for a first duration time during a reset period of a memory mode, the first duration time longer than a frame; a second step of eliminating the first vertical electric field and keeping the liquid crystal layer without the first horizontal electric field for a second duration time during the reset period of the memory mode; a third step of applying a second vertical electric field corresponding to a static image for a third duration time during a writing period of the memory mode, the third duration time longer than the frame; and a fourth step of eliminating the second vertical electric field and keeping the liquid crystal layer without the first vertical electric field for a fourth duration time during the writing period of the memory mode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments, examples of which are illustrated in the accompanying drawings.

Figure 1:
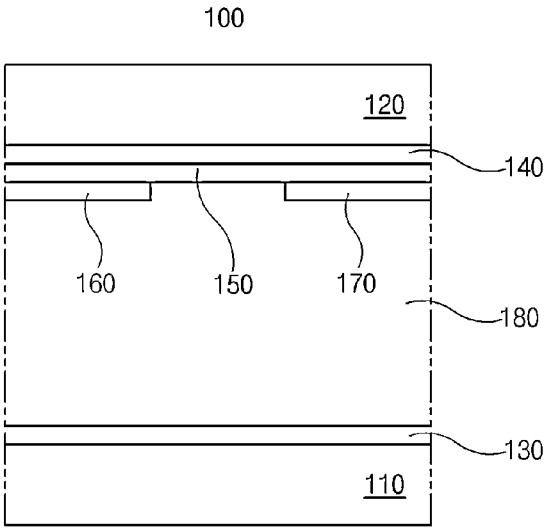
FIG. 1 is a cross-sectional view showing a dual mode liquid crystal display (LCD) device according to an embodiment of the present invention.

FIG. 1 is a cross-sectional view showing a dual mode liquid crystal display (LCD) device according to an embodiment of the present invention.

In FIG. 1, a dual mode LCD device 100 includes first and second substrates 110 and 120 facing and spaced apart from each other and a liquid crystal layer 180 between the first and second substrates 110 and 120. The dual mode LCD device 100 may have a transmissive type, a reflective type or a transflective type.

Although not shown, the first and second substrates 110 and 120 may include a plurality of pixel regions arranged in matrix along a plurality of row lines and a plurality of column lines. A plurality of gate lines may be formed along the plurality of row lines on an inner surface of the first substrate 110, and a plurality of data lines may be formed along the plurality of column lines on the inner surface of the first substrate 110. The plurality of pixel regions may be defined by the plurality of gate lines and the plurality of data lines crossing each other.

A first electrode 130 is formed in each pixel region on the inner surface of the first substrate 110 and the first electrode 130 may be connected to a thin film transistor (TFT) through a passivation layer between the first electrode 130 and the TFT.

A second electrode 140 is formed in each pixel region on an inner surface of the second substrate 120 and an insulating layer 150 is formed on the second electrode 140. The second electrode 140 may be formed on the entire surface of the second substrate 120.

Third and fourth electrodes 160 and 170 are formed on the insulating layer 150. Each of the third and fourth electrodes 160 and 170 may be formed at upper and lower end portions of each pixel region along the plurality of row lines. Alternatively, each of the third and fourth electrodes 160 and 170 may be formed at right and left end portions of each pixel region along the plurality of column lines.

In another embodiment, the third and fourth electrodes 160 and 170 may be formed over or under the first electrode 130 with an intervening insulating layer. In addition, the third and fourth electrodes 160 and 170 may be formed alternately over and under the first electrode 130 with an intervening insulating layer.

The first to fourth electrodes 130, 140, 160 and 170 may be formed of a transparent conductive material such as indium-tin oxide (ITO) and indium-zinc-oxide (IZO).

The liquid crystal layer 180 is formed between the first electrode 130 of the first substrate 110 and the third and fourth electrodes 160 and 170 of the second substrate 120. For example, the liquid crystal layer 180 may be formed by adding a chiral dopant to a nematic liquid crystal.

Although not shown, first and second alignment layers may be formed on the inner surfaces of first and second substrates 110 and 120, respectively, contacting the liquid crystal layer 180 for an initial alignment. Further, first and second polarizing layers may be formed on outer surfaces of the first and second substrates 110 and 120, respectively.

The dual mode LCD device 100 may include a gate driving unit and a data driving unit for turning on or off the TFT through the plurality of gate lines and the plurality of data lines and applying voltages to the first to fourth electrodes 130, 140, 160 and 170. For example, a maximum voltage outputted from the gate driving unit may have an absolute value of about 40V and a maximum voltage outputted from the data driving unit may have an absolute value of about 27V.

In the dual mode LCD device 100, a vertical electric field is generated between the first and second electrodes 130 and 140 by applying different voltages to the first and second electrodes 130 and 140, and a horizontal electric field is generated between the third and fourth electrodes 160 and 170 by applying different voltages to the third and fourth electrodes 160 and 170. The dual mode LCD device 100 may selectively operate in one of a memory mode and a dynamic mode by properly re-aligning liquid crystal molecules of the liquid crystal layer 180 due to generation (ON) and elimination (OFF) of the vertical electric field and the horizontal electric field.

Figure 2A:
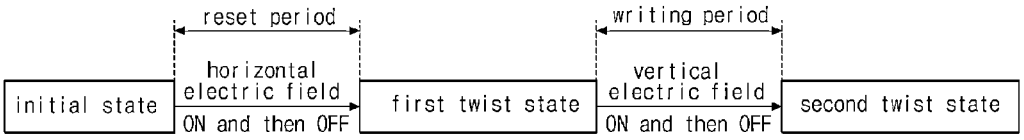
FIG. 2A is a view showing a state change of a liquid crystal layer in a memory mode of a dual mode LCD device according to an embodiment of the present invention.
Figure 2B:
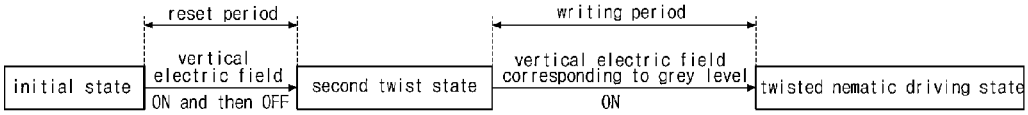
FIG. 2B is a view showing a state change of a liquid crystal layer in a dynamic mode of a dual mode LCD device according to an embodiment of the present invention.

FIGS. 2A and 2B are views showing a state change of a liquid crystal layer in a memory mode and a dynamic mode, respectively, of a dual mode LCD device according to an embodiment of the present invention. The state change will be illustrated with reference to FIG. 1.

In FIG. 2A, the liquid crystal layer 180 of the dual mode LCD device 100 transitions from an initial state to a first twist state by generating (ON) a horizontal electric field and then eliminating (OFF) the horizontal electric field during a reset period. The initial state may be a second twist state or another random state, and the first twist state may be a right twist state or a left twist state.

Next, the liquid crystal layer 180 transitions from the first twist state to the second twist state by generating (ON) a vertical electric field and then eliminating (OFF) the vertical electric field during a writing period. The second twist state may be the right twist state or the left twist state different from the first twist state. For example, the second twist state may be the right twist state when the first twist state is the left twist state, and the second twist state may be the left twist state when the first twist state is the right twist state. Since the first and second twist states are bi-stable states, the first and second twist states are maintained to display a static image even after the horizontal electric field or the vertical electric field is eliminated.

In FIG. 2B, the liquid crystal layer 180 of the dual mode LCD device 100 transitions from an initial state to a second twist state by generating (ON) a vertical electric field and then eliminating (OFF) the vertical electric field during a reset period. The initial state may be a first twist state or another random state, and the second twist state may be a right twist state or a left twist state.

Next, the liquid crystal layer 180 transitions from the second twist state to a twisted nematic (TN) driving state by generating (ON) the vertical electric field corresponding to a grey level during a writing period. The TN driving state may be the same as a driving state of a twisted nematic (TN) liquid crystal. In the TN driving state, for example, the liquid crystal layer 180 may be re-aligned such that a twist angle of liquid crystal molecules are changed according to the intensity of the generated vertical electric field. As a result, transmittance of the liquid crystal layer 180 is changed to display a moving image having varying grey levels.

The second twist state may be the right twist state or the left twist state different from the first twist state. For example, the second twist state may be the right twist state when the first twist state is the left twist state, and the second twist state may be the left twist state when the first twist state is the right twist state. Since the first and second twist states are bi-stable states, the first and second twist states are maintained even after the horizontal electric field or the vertical electric field is eliminated.

In a dynamic mode of another embodiment, the liquid crystal layer 180 may transition from an initial state to a first twist state by generating (ON) the horizontal electric field and then eliminating (OFF) the horizontal electric field during a reset period. Next, the liquid crystal layer 180 may transition from the first twist state to a TN driving state by generating (ON) a vertical electric field corresponding to a grey level during a writing period. The initial state may be a second twist state or another random state, and the first twist state may be a right twist state or a left twist state of one of bi-stable states. In addition, the TN driving state may be the same as a driving state of a twisted nematic (TN) liquid crystal. In the TN driving state, for example, the liquid crystal layer 180 may be re-aligned such that a twist angle of liquid crystal molecules are changed according to the intensity of the generated vertical electric field. As a result, transmittance of the liquid crystal layer 180 is changed to display a moving image having varying grey levels. Since the first twist state is one of bi-stable states, the first twist state is maintained even after the horizontal electric field is eliminated.

The dual mode LCD device 100 operates in a memory mode where a static image is displayed using the state change of FIG. 2A and operates in a dynamic mode where a moving image is displayed using the state change of FIG. 2B. The operation of the dual mode LCD device 100 will be illustrated hereinafter.

Figure 3:
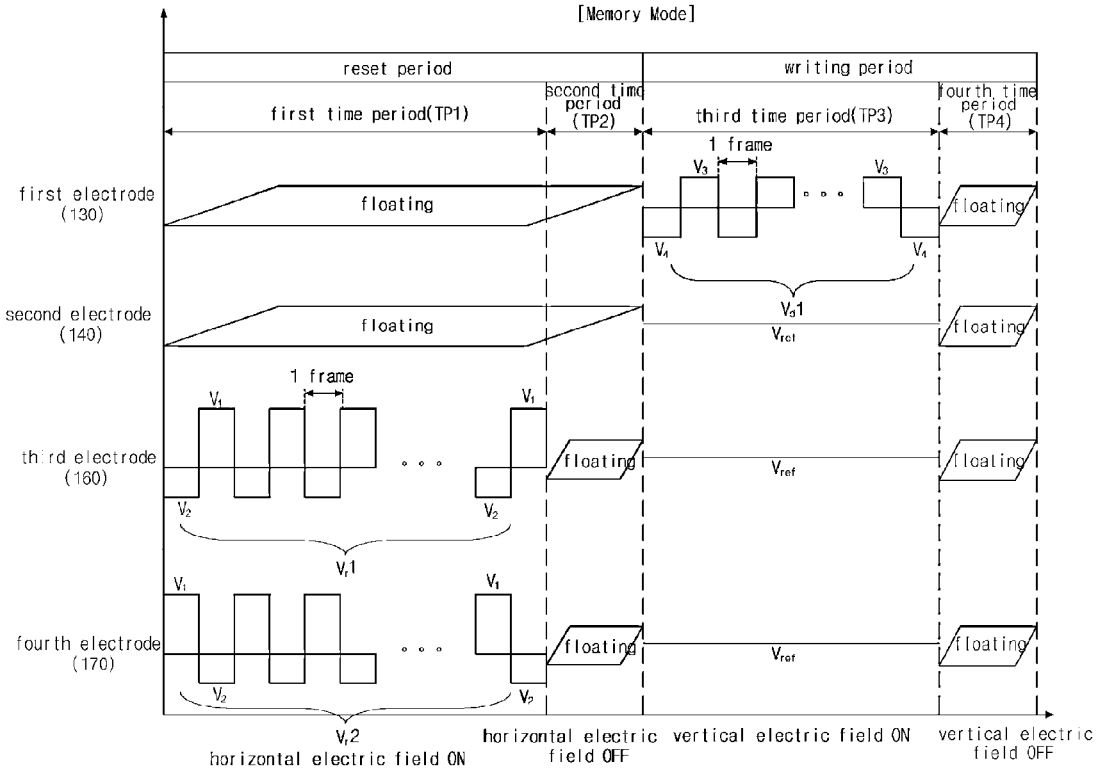
FIG. 3 is a timing chart showing a method of driving a dual mode LCD device in a memory mode according to an embodiment of the present invention.
Figure 4:
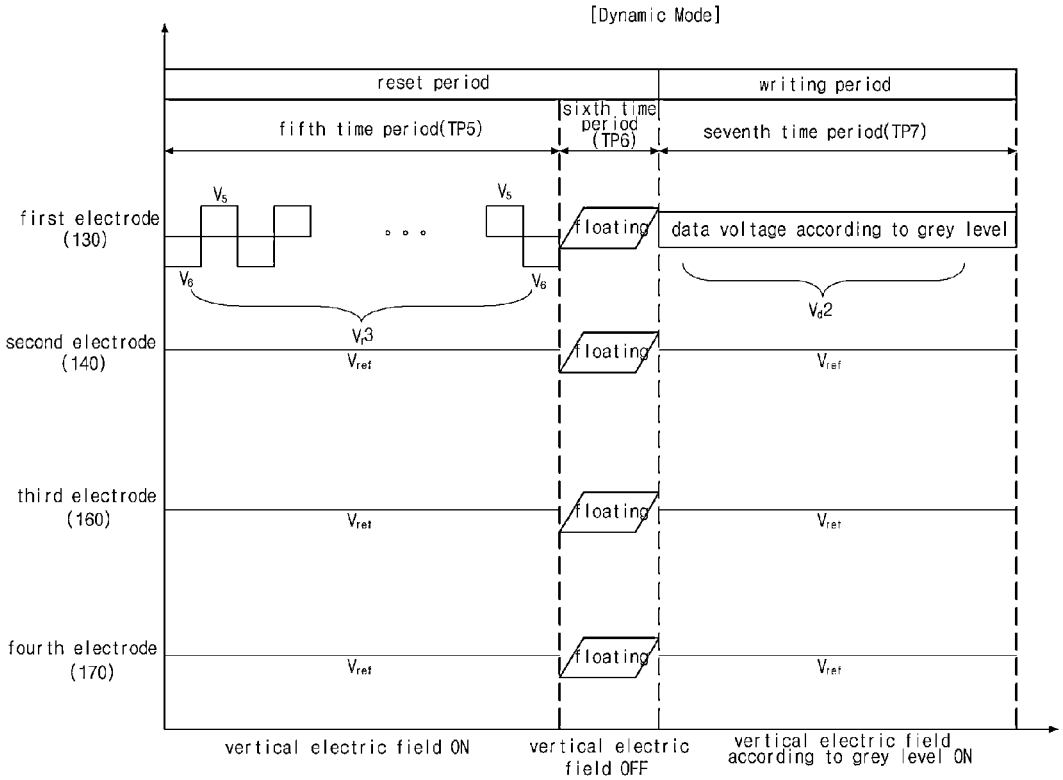
FIG. 4 is a timing chart showing a method of driving a dual mode LCD device in a dynamic mode according to an embodiment of the present invention.

FIG. 3 is a timing chart showing a method of driving a dual mode LCD device in a memory mode according to an embodiment of the present invention, and FIG. 4 is a timing chart showing a method of driving a dual mode LCD device in a dynamic mode according to an embodiment of the present invention. The operation will be illustrated with reference to FIGS. 1, 2A and 2B.

In FIG. 3, a method of driving the dual mode LCD device 100 in a memory mode includes a reset period and a writing period. The reset period includes first and second time periods TP1 and TP2. A duration time of the reset period is a sum of a first duration time of the first time period TP1 and a second duration time of the second time period TP2.

In the first time period TP1, the first and second electrodes 130 and 140 of each pixel region are electrically floating, and first and second reset voltages Vr1 and Vr2 different from each other are applied to the third and fourth electrodes 160 and 170, respectively, of each pixel region for the first duration time. As a result, a horizontal electric field is generated between the third and fourth electrodes 160 and 170 along a direction perpendicular to each of the third and fourth electrodes 160 and 170 to be applied to the liquid crystal layer 180. (ON)

Each of the first and second reset voltages Vr1 and Vr2 may alternately have a first voltage V1 of a high level and a second voltage V2 of a low level. For example, the first reset voltage Vr1 applied to the third electrode 160 may have the first voltage V1 of a high level and the second reset voltage Vr2 applied to the fourth electrode 170 may have the second voltage V2 of a low level during a frame of the first time period TP1. In addition, the first reset voltage Vr1 applied to the third electrode 160 may have the second voltage V2 of a low level and the second reset voltage Vr2 applied to the fourth electrode 170 may have the first voltage V1 of a high level during a next frame of the first time period TP1. The first duration time may be longer than a single frame (e.g. about 16.7 msec for 60 Hz).

Since the first voltage V1 of a high level and the second voltage V2 of a low level are alternately applied to each of the third and fourth electrodes 160 and 170, a charge accumulation on the third and fourth electrodes 160 and 170 is prevented. In another embodiment where the charge accumulation does not cause any problem, one of the first voltage V1 of a high level and the second voltage V2 of a low level may be steadily applied to each of the third and fourth electrodes 160 and 170.

In yet another embodiment, one of the first voltage V1 of a high level having a different absolute value by frame and the second voltage V2 of a low level having a different absolute value by frame may be applied to each of the third and fourth electrodes 160 and 170.

In yet another embodiment, the first and second reset voltages Vr1 and Vr2 different from each other may be applied to the first and second electrodes 130 and 140, respectively, and the third and fourth electrodes 160 and 170 may be electrically floating for the first duration time. As a result, a vertical electric field may be generated between the first and second electrodes 130 and 140 to be applied to the liquid crystal layer 180. (ON) Each of the first and second reset voltages Vr1 and Vr2 may alternately have the first voltage V1 of a high level and the second voltage V2 of a low level. For example, the first reset voltage Vr1 applied to the first electrode 130 may have the first voltage V1 of a high level and the second reset voltage Vr2 applied to the second electrode 140 may have the second voltage V2 of a low level during a frame of the first time period TP1. In addition, the first reset voltage Vr1 applied to the first electrode 130 may have the second voltage V2 of a low level and the second reset voltage Vr2 applied to the second electrode 140 may have the first voltage V1 of a high level during a next frame of the first time period TP1. The first duration time may be longer than a single frame (e.g. about 16.7 msec for 60 Hz).

In the second time period TP2, the first to fourth electrodes 130, 140, 160 and 170 of each pixel region are electrically floating for the second duration time. As a result, the horizontal electric field is eliminated. (OFF)

In another embodiment, the horizontal electric field may be eliminated when a fixed voltage is applied to the first to fourth electrodes 130, 140, 160 and 170. Alternatively, the horizontal electric field may be eliminated when a fixed voltage is applied to some of the first to fourth electrodes 130, 140, 160 and 170 and the others of the first to fourth electrodes 130, 140, 160 and 170 are floating.

During the reset period, accordingly, the liquid crystal molecules of the liquid crystal layer 180 of each pixel region has the first twist state one of bi-stable states due to generation (ON) and elimination (OFF) of the horizontal electric field, and the plurality of pixel regions of the dual mode LCD device 100 in the first twist state display a single grey level, for example, white or black as a whole.

The writing period includes third and fourth time periods TP3 and TP4. A duration time of the writing period is a sum of a third duration time of the third time period TP3 and a fourth duration time of the fourth time period TP4.

In the third time period TP3, a first driving voltage Vd1 corresponding to a static image of each pixel region is applied to the first electrode 130, and a reference voltage Vref is applied to the second to fourth electrodes 140, 160 and 170 for the third duration time. The first driving voltage Vd1 may have different values in the plurality of pixel regions for displaying the static image. As a result, a vertical electric field is generated between the first and second electrodes 130 and 140 to be applied to the liquid crystal layer 180. (ON) The vertical electric field may have different intensities in the plurality of pixel regions to display different grey levels corresponding to the static image.

The first driving voltage Vd1 may alternately have a third voltage V3 of a high level and a fourth voltage V4 of a low level to prevent a charge accumulation on the first and second electrodes 130 and 140. For example, the first driving voltage Vd1 applied to the first electrode 130 may have the third voltage V3 of a high level during a frame of the third time period TP3, and the first driving voltage Vd1 applied to the first electrode 130 may have the fourth voltage V4 of a low level during a next frame of the third time period TP3. The third voltage V3 may be greater than the reference voltage Vref and the fourth voltage V4 may be smaller than the reference voltage Vref. Since the difference between the third and fourth voltages V3 and V4 is not changed for displaying a static image, the third and fourth voltages V3 and V4 may be symmetrical with respect to the reference voltage Vref.

The reference voltage Vref may have a voltage corresponding to an average value of the third and fourth voltages V3 and V4. For example, the reference voltage Vref may have a half voltage (Vhvdd) of the maximum output voltage (VDD) of the data driving unit. The third duration time may be longer than a single frame (e.g. about 16.7 msec for 60 Hz).

In another embodiment where the charge accumulation does not cause any problem, one of the third voltage V3 of a high level and the fourth voltage V4 of a low level may be steadily applied to the first electrode 130.

In the fourth time period TP4, the first to fourth electrodes 130, 140, 160 and 170 are electrically floating for the fourth duration time. As a result, the vertical electric field is eliminated. (OFF)

During the writing period, accordingly, the liquid crystal molecules of the liquid crystal layer 180 transitions to the second twist state one of bi-stable states due to generation (ON) and elimination (OFF) of the vertical electric field, and the plurality of pixel regions of the dual mode LCD device 100 in the second twist state display a static image.

Since the second twist state is one of bi-stable states, the dual mode LCD device 100 displays the static image without supply of a voltage until a different voltage is applied to the first electrode 130.

Accordingly, the dual mode LCD device 100 operates in the memory mode where the static image is displayed through the reset period and the writing period.

In FIG. 4, a method of driving the dual mode LCD device 100 in a memory mode includes a reset period and a writing period. The reset period includes fifth and sixth time periods TP5 and TP6. A duration time of the reset period is a sum of a fifth duration time of the fifth time period TP5 and a sixth duration time of the sixth time period TP6.

In the fifth time period TP5, a third reset voltage Vr3 is applied to the first electrode 130 of each pixel region, and a reference voltage Vref is applied to the second to fourth electrodes 140, 160 and 170 of each pixel region for the fifth duration time. As a result, a vertical electric field is generated between the first and second electrodes 130 and 140 to be applied to the liquid crystal layer 180. (ON)

The third reset voltage Vr3 may alternately have a fifth voltage V5 of a high level and a sixth voltage V6 of a low level to prevent a charge accumulation on the first and second electrodes 130 and 140. For example, the third reset voltage Vr3 applied to the first electrode 130 may have the fifth voltage V5 of a high level during a frame of the fifth time period TP5, and the third reset voltage Vr3 applied to the first electrode 130 may have the sixth voltage V6 of a low level during a next frame of the fifth time period TP5. The fifth voltage V5 may be greater than the reference voltage Vref and the sixth voltage V6 may be smaller than the reference voltage Vref. Since the difference between the fifth and sixth voltages V5 and V6 is not changed for resetting, the fifth and sixth voltages V5 and V6 may be symmetrical with respect to the reference voltage Vref.

The reference voltage Vref may have a voltage corresponding to an average value of the fifth and sixth voltages V5 and V6. For example, the reference voltage Vref may have a half voltage (Vhvdd) of the maximum output voltage (VDD) of the data driving unit. The fifth duration time may be longer than a single frame (e.g. about 16.7 msec for 60 Hz).

In another embodiment where the charge accumulation does not cause any problem, one of the fifth voltage V5 of a high level and the sixth voltage V6 of a low level may be steadily applied to the first electrode 130.

In the sixth time period TP6, the first to fourth electrodes 130, 140, 160 and 170 are electrically floating for the sixth duration time. As a result, the vertical electric field is eliminated. (OFF)

During the writing period, accordingly, the liquid crystal molecules of the liquid crystal layer 180 of each pixel region has the second twist state one of bi-stable states due to generation (ON) and elimination (OFF) of the vertical electric field, and the plurality of pixel regions of the dual mode LCD device 100 in the second twist state display a single grey level, for example, white or black as a whole.

One of the reset period of the memory mode and the writing period of the memory mode may be used as the reset period of the dynamic mode according to an optical design, a material and a rubbing direction of the dual mode LCD device 100. Although the writing period of the memory mode is used as the reset period of the dynamic mode in FIG. 4, the reset period of the memory mode may be used as the reset period of the dynamic mode in another embodiment.

In FIG. 4, after the reset period of the dynamic mode the same as the writing period of the memory mode, the liquid crystal layer 180 transitions to the second twist state one of bi-stable states and then the moving image is displayed during the writing period of the dynamic mode by driving the liquid crystal layer 180 with a method similar to that for the TN liquid crystal. In another embodiment, after the reset period of the dynamic mode the same as the reset period of the memory mode, the liquid crystal layer 180 may transition to the first twist state one of bi-stable states and then the moving image may be displayed during the writing period of the dynamic mode by driving the liquid crystal layer 180 with a method similar to that for the TN liquid crystal.

The writing period includes seventh time period TP7. The method of driving the liquid crystal layer 180 during the writing period of the dynamic mode is substantially the same as the method of driving the TN liquid crystal.

In the seventh time period TP7, a second driving voltage Vd2 corresponding to a moving image of each pixel region is applied to the first electrode 130, and a reference voltage is applied to the second to fourth electrodes 140, 160 and 170 for a seventh duration time. The second driving voltage Vd2 may have different values in the plurality of pixel regions and in the frames for displaying the moving image. As a result, a vertical electric field is generated between the first and second electrodes 130 and 140 to be applied to the liquid crystal layer 180. (ON) The vertical electric field may have different intensities in the plurality of pixel regions and in the frames to display different grey levels corresponding to the moving image.

A range of the second driving voltage Vd2 for the writing period of the dynamic mode may be higher than a range of the first driving voltage Vd1 for the writing period of the memory mode. Accordingly, when the liquid crystal layer 180 has one of bi-stable states, the liquid crystal layer 180 transitions to the other of bi-stable states by applying a vertical electric field due to the first driving voltage Vd1 of a relatively high range so that the writing period of the memory mode can be performed. Further, when the liquid crystal layer 180 has one of bi-stable states, the liquid crystal layer 180 transitions to the TN driving state by applying a vertical electric field due to the second driving voltage Vd2 of a relatively low range so that the writing period of the dynamic mode can be performed.

The second driving voltage Vd2 may be a data voltage which varies by frames to correspond to the grey level of each pixel region. Further, the second driving voltage Vd2 may alternately have voltages to prevent a charge accumulation on the first and second electrodes 130 and 140. For example, the second driving voltage Vd2 applied to the first electrode 130 may have the data voltage of a high level during a frame of the seventh time period TP7, and the second driving voltage Vd2 applied to the first electrode 130 may have the data voltage of a low level during a next frame of the seventh time period TP7. The data voltage of a high level may be greater than the reference voltage Vref and the data voltage of a low level may be smaller than the reference voltage Vref.

The reference voltage Vref may have a voltage corresponding to an average value of the data voltage of a high level and the data voltage of a low level. For example, the reference voltage Vref may have a half voltage (Vhvdd) of the maximum output voltage of the data driving unit.

In another embodiment where the charge accumulation does not cause any problem, one of the data voltages of high and low levels may be steadily applied to the first electrode 130.

In yet another embodiment, the vertical electric field may be generated by applying the second driving voltage Vd2 corresponding to the moving image to the second electrode 140 and applying the reference voltage to the first, third and fourth electrodes 130, 160 and 170. In yet another embodiment, the vertical electric field may be generated by applying the second driving voltage Vd2 corresponding to the moving image to the third and fourth electrodes 160 and 170 and applying the reference voltage to the first and second electrodes 130 and 140. In yet another embodiment where the third and fourth electrodes 160 and 170 are formed on the inner surface of the first substrate 110, the vertical electric field may be generated by applying the second driving voltage Vd2 corresponding to the moving image to the third and fourth electrodes 160 and 170 on the first substrate 110 and applying the reference voltage to the first and second electrodes 130 and 140.

The seventh time period TP7 may be maintained until the change from the dynamic mode to the memory mode or until the end of displaying the moving image. Similarly to the TN liquid crystal, during the writing period, the liquid crystal layer 180 may be re-aligned such that a twist angle of liquid crystal molecules are changed according to the intensity of the generated vertical electric field. As a result, transmittance of the liquid crystal layer 180 is changed to display a moving image having varying grey levels.

Accordingly, the dual mode LCD device 100 operates in the dynamic mode where the moving image is displayed through the reset period and the writing period.

Figure 5A:
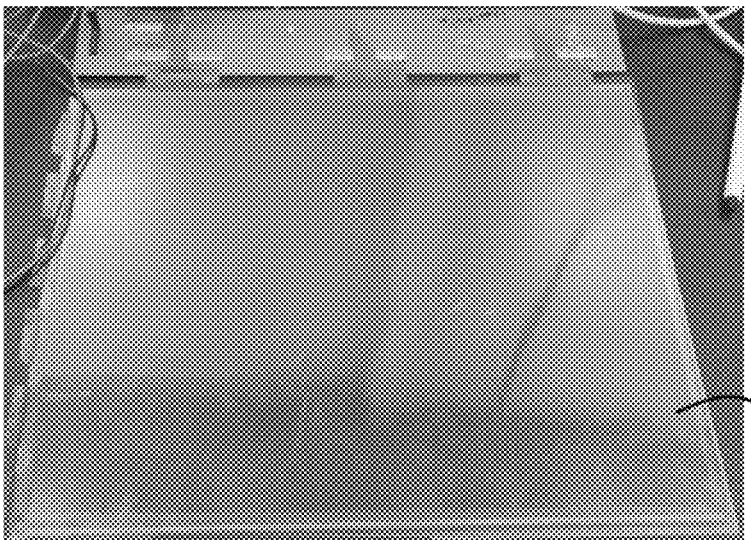
FIG. 5A is a view showing a dual mode LCD device according to an embodiment of the present invention after a reset period of a memory mode.
Figure 5B:
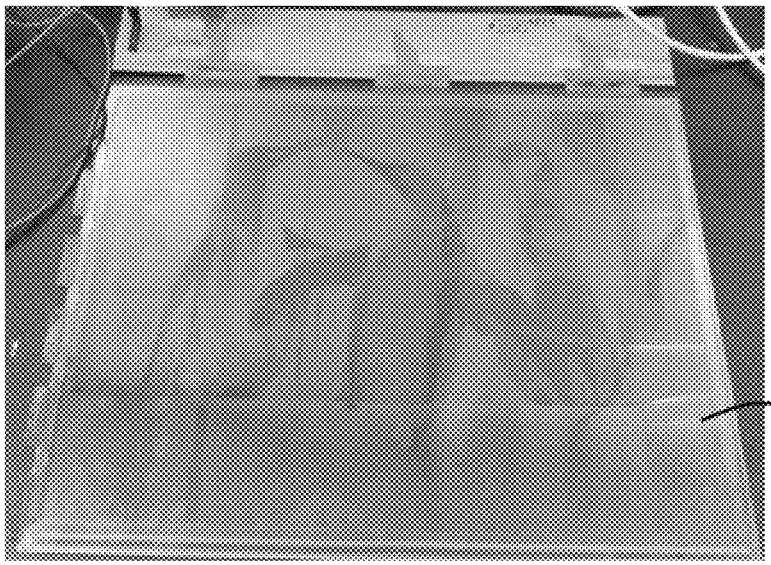
FIG. 5B is a view showing a dual mode LCD device according to an embodiment of the present invention in a writing period of a dynamic mode.

FIG. 5A is a view showing a dual mode LCD device according to an embodiment of the present invention after a reset period of a memory mode, and FIG. 5B is a view showing a dual mode LCD device according to an embodiment of the present invention in a writing period of a dynamic mode.

In FIG. 5A, after the reset period of the memory mode, the plurality of the dual mode LCD device 100 have the same grey level as each other and the dual mode LCD device 100 displays white as a whole. Next, the dual mode LCD device 100 may keep displaying a static image without supply of a voltage by generating (ON) and eliminating (OFF) the vertical electric field due to the first and second electrodes 130 and 140.

In FIG. 5B, the dual mode LCD device 100 may display a moving image (e.g. penguin) by generating the vertical electric field having varying intensity due to the first and second electrodes 130 and 140.

In the method of driving the dual mode LCD device according to the present disclosure, both of a static image and a moving image are stably displayed with a single display panel by constituting each of the memory mode and the dynamic mode with the reset period and the writing period. In addition, the liquid crystal molecules have a bi-stable state due to the vertical electric field in the memory mode and have a monostable state due to the horizontal electric field in the dynamic mode. As a result, both of a static image and a moving image are stably displayed with a single display panel.

It will be apparent to those skilled in the art that various modifications and variations can be made in a method of driving a dual mode liquid crystal display device of the present disclosure without departing from the sprit or scope of the invention. Thus, it is intended that the present invention covers the modifications and variations of this invention provided they come within the scope of the appended claims and their equivalents.

What is claimed is:

1. A method of driving a dual mode liquid crystal display device comprising first and second substrates facing and spaced apart from each other, the first and second substrates including a plurality of pixel regions, a first electrode in each of the plurality of pixel regions on an inner surface of the first substrate, a second electrode on an inner surface of the second substrate, third and fourth electrodes on one of the inner surfaces of the first and second substrates, the third and fourth electrodes spaced apart from each other, and a liquid crystal layer between the first and second substrates, the liquid crystal layer including a liquid crystal and a chiral dopant, the method comprising:

a first step of applying a first horizontal electric field to the liquid crystal layer for a first duration time during a reset period of a memory mode, the first duration time longer than a frame;

a second step of eliminating the first horizontal electric field and keeping the liquid crystal layer without the first horizontal electric field for a second duration time during the reset period of the memory mode;

a third step of applying a first vertical electric field corresponding to a static image for a third duration time during a writing period of the memory mode, the third duration time longer than the frame;

a fourth step of eliminating the first vertical electric field and keeping the liquid crystal layer without the first vertical electric field for a fourth duration time during the writing period of the memory mode;

a fifth step of applying a second vertical electric field to the liquid crystal layer for a fifth duration time during a reset period of a dynamic mode, the fifth duration time longer than the frame;

a sixth step of eliminating the second vertical electric field and keeping the liquid crystal layer without the second vertical electric field for a sixth duration time during the reset period of the dynamic mode; and a seventh step of applying a third vertical electric field corresponding to a moving image during a writing period of the dynamic mode.

2. A method of driving a dual mode liquid crystal display device comprising first and second substrates facing and spaced apart from each other, the first and second substrates including a plurality of pixel regions, a first electrode in each of the plurality of pixel regions on an inner surface of the first substrate, a second electrode on an inner surface of the second substrate, third and fourth electrodes on one of the inner surfaces of the first and second substrates, the third and fourth electrodes spaced apart from each other, and a liquid crystal layer between the first and second substrates, the liquid crystal layer including a liquid crystal and a chiral dopant, the method comprising:

a first step of applying a first horizontal electric field to the liquid crystal layer for a first duration time during a reset period of a memory mode, the first duration time longer than a frame;

a second step of eliminating the first horizontal electric field and keeping the liquid crystal layer without the first horizontal electric field for a second duration time during the reset period of the memory mode;

a third step of applying a first vertical electric field corresponding to a static image for a third duration time during a writing period of the memory mode, the third duration time longer than the frame; and a fourth step of eliminating the first vertical electric field and keeping the liquid crystal layer without the first vertical electric field for a fourth duration time during the writing period of the memory mode, wherein the liquid crystal layer has one of a right twist state and a left twist state after the second step, and the liquid crystal layer has the other of the right twist state and the left twist state after the fourth step.

3. A method of driving a dual mode liquid crystal display device comprising first and second substrates facing and spaced apart from each other, the first and second substrates including a plurality of pixel regions, a first electrode in each of the plurality of pixel regions on an inner surface of the first substrate, a second electrode on an inner surface of the second substrate, third and fourth electrodes on one of the inner surfaces of the first and second substrates, the third and fourth electrodes spaced apart from each other, and a liquid crystal layer between the first and second substrates, the liquid crystal layer including a liquid crystal and a chiral dopant, the method comprising:

a first step of applying a first horizontal electric field to the liquid crystal layer for a first duration time during a reset period of a memory mode, the first duration time longer than a frame;

a second step of eliminating the first horizontal electric field and keeping the liquid crystal layer without the first horizontal electric field for a second duration time during the reset period of the memory mode;

a third step of applying a first vertical electric field corresponding to a static image for a third duration time during a writing period of the memory mode, the third duration time longer than the frame;

a fourth step of eliminating the first vertical electric field and keeping the liquid crystal layer without the first vertical electric field for a fourth duration time during the writing period of the memory mode;

a fifth step of applying a second horizontal electric field to the liquid crystal layer for a fifth duration time during a reset period of a dynamic mode, the fifth duration time longer than the frame;

a sixth step of eliminating the second horizontal electric field and keeping the liquid crystal layer without the second horizontal electric field for a sixth duration time during the reset period of the dynamic mode; and a seventh step of applying a second vertical electric field corresponding to a moving image during a writing period of the dynamic mode.

4. The method according to claim 1, wherein the first step includes a step of making the first and second electrodes electrically floating and alternately applying first and second reset voltages different from each other by frames to each of the third and fourth electrodes where.

5. The method according to claim 1, wherein the second step includes one of a step of making the first to fourth electrodes electrically floating, a step of applying a fixed voltage to some of the first to fourth electrodes and making the others of the first to fourth electrodes electrically floating and a step of applying the fixed voltage to the first to fourth electrodes.

6. The method according to claim 1, wherein the third step includes a step of applying a first driving voltage to the first electrode and applying a reference voltage to the second to fourth electrodes.

7. The method according to claim 6, wherein the fourth step includes a step of making the first to fourth electrodes electrically floating.

8. The method according to claim 6, wherein the seventh step includes a step of applying a second driving voltage corresponding to the moving image to one of the first and second electrodes and applying the reference voltage to the other of the first and second electrodes and the third and fourth electrodes.

9. The method according to claim 8, wherein a range of the first driving voltage is higher than a range of the second driving voltage.

10. The method according to claim 6, wherein the seventh step includes a step of applying a second driving voltage to the third and fourth electrodes and applying the reference voltage to the first and second electrodes.

11. A method of driving a dual mode liquid crystal display device comprising first and second substrates facing and spaced apart from each other, the first and second substrates including a plurality of pixel regions, a first electrode in each of the plurality of pixel regions on an inner surface of the first substrate, a second electrode on an inner surface of the second substrate, third and fourth electrodes on one of the inner surfaces of the first and second substrates, the third and fourth electrodes spaced apart from each other, and a liquid crystal layer between the first and second substrates, the liquid crystal layer including a liquid crystal and a chiral dopant, the method comprising:

a first step of applying a first vertical electric field to the liquid crystal layer for a first duration time during a reset period of a memory mode, the first duration time longer than a frame;

a second step of eliminating the first vertical electric field and keeping the liquid crystal layer without the first horizontal electric field for a second duration time during the reset period of the memory mode;

a third step of applying a second vertical electric field corresponding to a static image for a third duration time during a writing period of the memory mode, the third duration time longer than the frame;

a fourth step of eliminating the second vertical electric field and keeping the liquid crystal layer without the first vertical electric field for a fourth duration time during the writing period of the memory mode;

a fifth step of applying a third vertical electric field to the liquid crystal layer for a fifth duration time during a reset period of a dynamic mode, the fifth duration time longer than the frame;

a sixth step of eliminating the third vertical electric field and keeping the liquid crystal layer without the third vertical electric field for a sixth duration time during the reset period of the dynamic mode; and a seventh step of applying a fourth vertical electric field corresponding to a moving image during a writing period of the dynamic mode.

12. A method of driving a dual mode liquid crystal display device comprising first and second substrates facing and spaced apart from each other, the first and second substrates including a plurality of pixel regions, a first electrode in each of the plurality of pixel regions on an inner surface of the first substrate, a second electrode on an inner surface of the second substrate, third and fourth electrodes on one of the inner surfaces of the first and second substrates, the third and fourth electrodes spaced apart from each other, and a liquid crystal layer between the first and second substrates, the liquid crystal layer including a liquid crystal and a chiral dopant, the method comprising:

a first step of applying a first vertical electric field to the liquid crystal layer for a first duration time during a reset period of a memory mode, the first duration time longer than a frame;

a second step of eliminating the first vertical electric field and keeping the liquid crystal layer without the first horizontal electric field for a second duration time during the reset period of the memory mode;

a third step of applying a second vertical electric field corresponding to a static image for a third duration time during a writing period of the memory mode, the third duration time longer than the frame;

a fourth step of eliminating the second vertical electric field and keeping the liquid crystal layer without the first vertical electric field for a fourth duration time during the writing period of the memory mode;

a fifth step of applying a first horizontal electric field to the liquid crystal layer for a fifth duration time during a reset period of a dynamic mode, the fifth duration time longer than the frame;

a sixth step of eliminating the first horizontal electric field and keeping the liquid crystal layer without the first horizontal electric field for a sixth duration time during the reset period of the dynamic mode; and a seventh step of applying a third vertical electric field corresponding to a moving image during a writing period of the dynamic mode.

13. A method of driving a dual mode liquid crystal display device comprising first and second substrates facing and spaced apart from each other, the first and second substrates including a plurality of pixel regions, a first electrode in each of the plurality of pixel regions on an inner surface of the first substrate, a second electrode on an inner surface of the second substrate, third and fourth electrodes on one of the inner surfaces of the first and second substrates, the third and fourth electrodes spaced apart from each other, and a liquid crystal layer between the first and second substrates, the liquid crystal layer including a liquid crystal and a chiral dopant, the method comprising:

a first step of applying a first vertical electric field to the liquid crystal layer for a first duration time during a reset period of a memory mode, the first duration time longer than a frame;

a second step of eliminating the first vertical electric field and keeping the liquid crystal layer without the first horizontal electric field for a second duration time during the reset period of the memory mode;

a third step of applying a second vertical electric field corresponding to a static image for a third duration time during a writing period of the memory mode, the third duration time longer than the frame; and a fourth step of eliminating the second vertical electric field and keeping the liquid crystal layer without the first vertical electric field for a fourth duration time during the writing period of the memory mode, wherein the liquid crystal layer has one of a right twist state and a left twist state after the second step, and the liquid crystal layer has the other of the right twist state and the left twist state after the fourth step.

* * * * *